US005649700A

United States Patent [19]

Suh et al.

[11] Patent Number: 5,649,700

[45] Date of Patent: Jul. 22, 1997

[54] HORIZONTALLY-MAINTAINED TABLE TENNIS TABLE

[76] Inventors: Jung-Tae Suh, 2-103, Janghan Apt, 1 Kongdandong, Gumisi, Kyungsangbukdo; Bum-Kyo Suh, 302-307, Woosung 7 APT, Moonchonli, (5/5) 32 Juyupdong, Koyangsi, Kyongkido, both of Rep. of Korea

[21] Appl. No.: 629,530

[22] Filed: Apr. 9, 1996

[51] Int. Cl.[6] ..... A63B 39/00

[52] U.S. Cl. ..... 473/496

[58] Field of Search ..... 273/30; 473/4, 473/12, 33, 29

[56] References Cited

U.S. PATENT DOCUMENTS

| | | | |
|---|---|---|---|
| 476,324 | 6/1892 | Stanks | 473/33 |
| 964,996 | 7/1910 | Matthes | 273/30 |
| 1,995,543 | 3/1935 | Kaser | 273/30 |
| 4,345,758 | 8/1982 | Kempf | 273/30 |
| 4,762,321 | 8/1988 | Chang | 273/30 |

FOREIGN PATENT DOCUMENTS

| | | | |
|---|---|---|---|
| 784500 | 7/1935 | France | 273/30 |
| 963206 | 7/1950 | France | 473/33 |
| 500754 | 2/1939 | United Kingdom | 273/30 |

*Primary Examiner*—Theatrice Brown

*Attorney, Agent, or Firm*—Birch, Stewart, Kolasch & Birch, LLP

[57] ABSTRACT

A horizontally-maintained table tennis table which comprises a table tennis table top having two sections, one section being provided with a lateral coupling hole and the other section being provided with a lateral bar, said lateral bar being inserted into the lateral coupling hole to connect the two sections together, locking means for locking the two sections together, level-measuring means provided in the peripheral edges of the table tennis table top, table tennis table legs for supporting the table top, and height-adjusting means provided in the table legs.

2 Claims, 3 Drawing Sheets

HORIZONTALLY-MAINTAINED TABLE TENNIS TABLE

BACKGROUND OF THE INVENTION

The present invention relates to a horizontally maintained table tennis table in which levels are provided on the table board of the table tennis table so as to be able to adjust the height of the legs and to fix both table tennis tables together so that they can be made to be horizontal whereby a scientific table tennis table can be made.

Although a conventional table tennis table is made by connecting the same sized rectangular table tennis tables in a side-by-side relationship, the desired horizontal state of the table could not be confirmed by the naked eye. Thus, it could only be assumed that the table was in a horizontal condition and there was no convenient way to accurately determine whether or not the table is really horizontal.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE INVENTION

Figure 1:
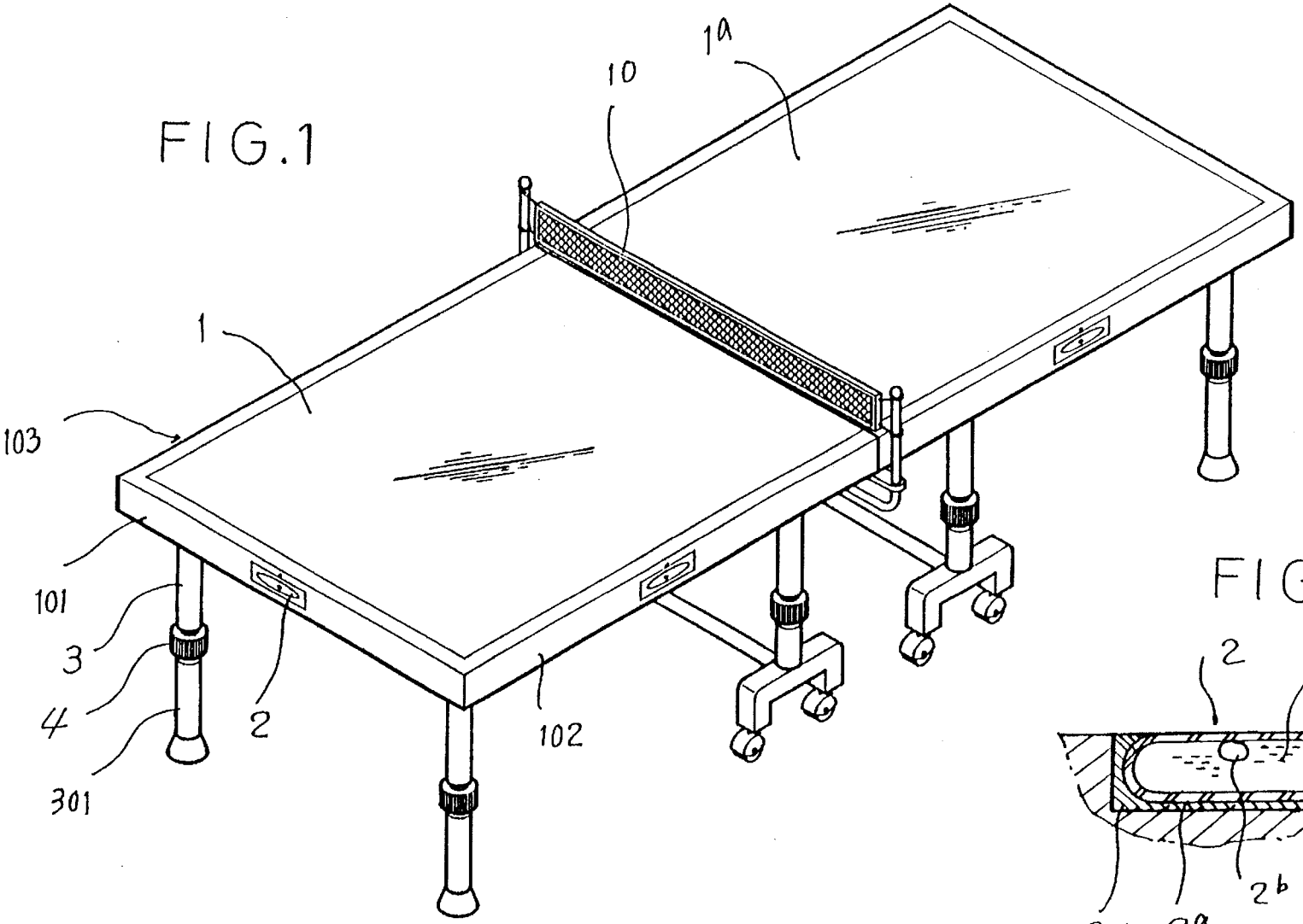
FIG. 1 is a perspective view of the present invention.
Figure 5:
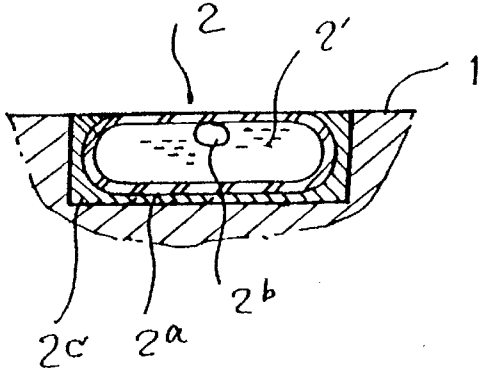
FIG. 5 is a magnified cross sectional view of a leveler utilized in the present invention.
Figure 2:
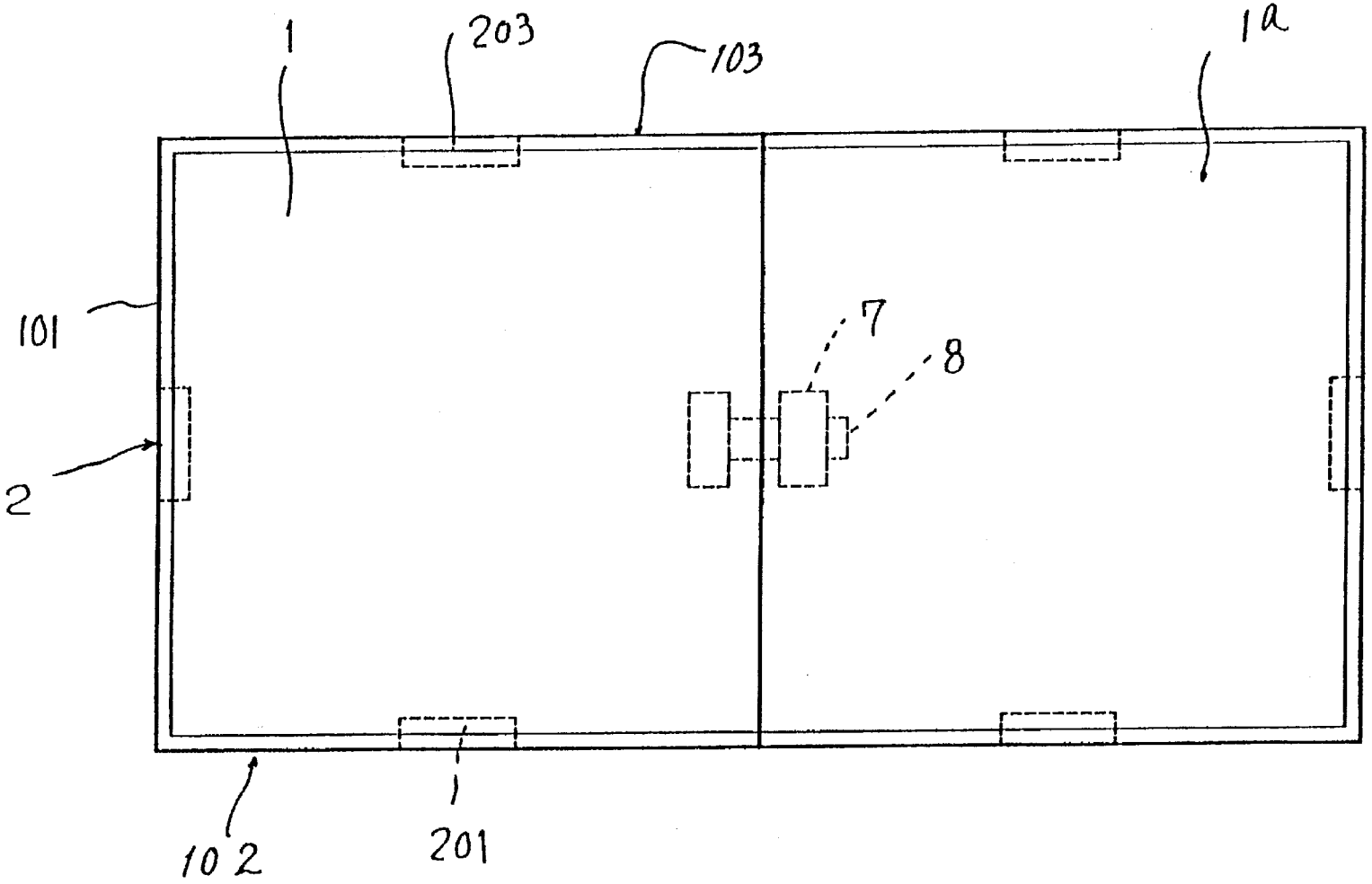
FIG. 2 is a plane view of the present invention.
Figure 4:
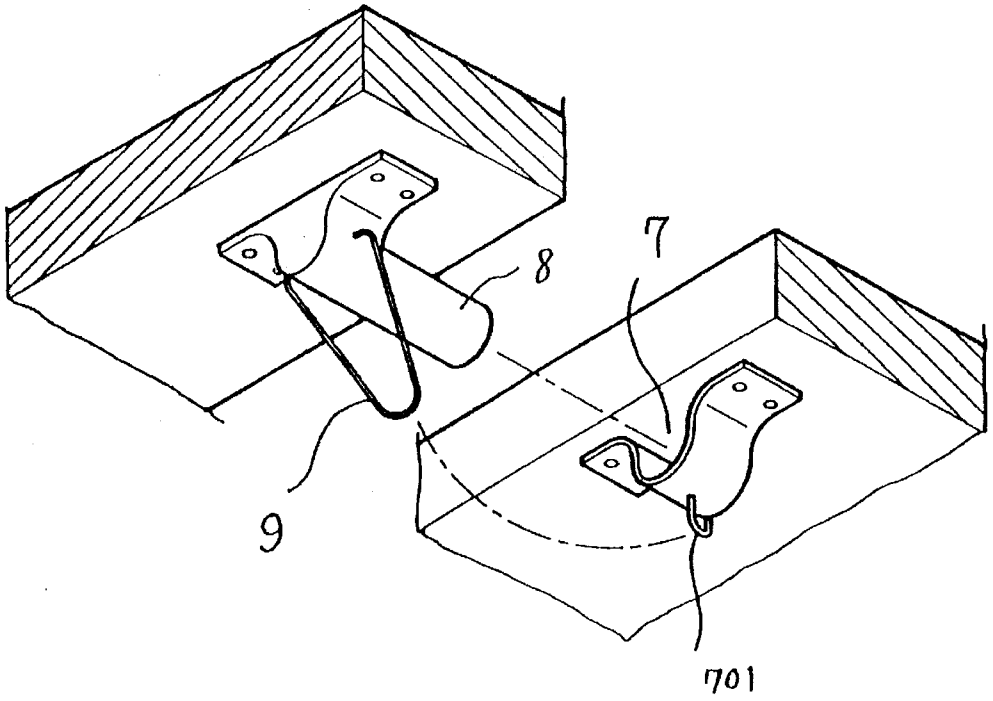
FIG. 4 is an exploded perspective view of table connecting portions of the present invention.
Figure 3:
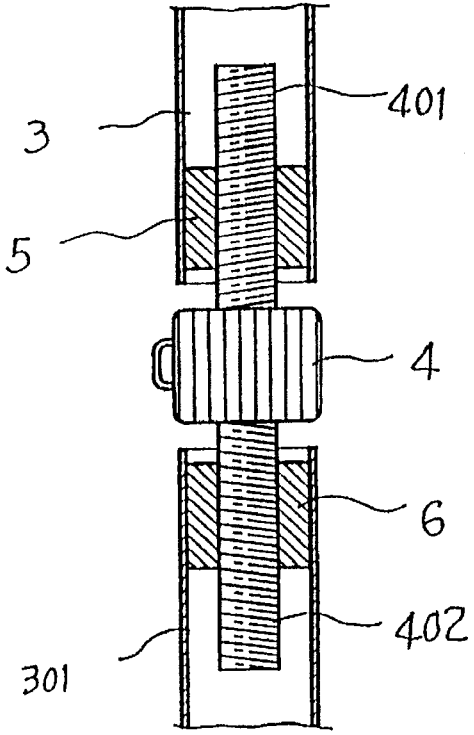
FIG. 3 is a cross sectional view of the height adjusting means of the present invention.

The present invention will be describe in more detail with reference to the accompanying drawings.

In the structure of the present invention, levels 2 are provided by providing grooves at the center line of the peripheral edges 101, 102, and 103 of the tennis table board 1 so that a bubble portion 2*b* of the leveler 2 is exposed to exterior; the table legs are divided into a supporting portion 3 and a lower portion 301 so that by adjusting a right-hand screw nut 5 and a left-hand screw nut 6 disposed at the bottom end of the supporting leg 3 and at the top end of the grounding leg 301, a height adjustment can be made. A handle 4 is provided at a center position with a right-hand screw bar 401 and a left-hand screw bar 402 being symmetrically formed integral in both directions thereof so that the table height can be manually adjusted. A lateral coupling hole 7 is provided on one side of the connecting portions of the table tennis table boards 1,1*a* where a net 10 is to be provided. A lateral bar 8 is provided on the opposite side and then a lateral bar is inserted into the lateral coupling hole 7 and a hook 9 of the lateral bar is hooked to a hooking loop 701 so as to fix the two table tennis table boards together.

When the table tennis table boards 1,1*a* of the present invention are connected together and made to be horizontal by adjusting the height of the supporting leg 3 by turning the height adjusting means 4 a horizontally adjusted table tennis table can be obtained, and maintained by hooking the hook 9 to the hooking loop 701. Thus; there is no worry that one person will be disadvantaged when playing table tennis. Because the levelers 2 provided for the table tennis table board are exposed at the peripheral edges there of, the horizontal state of the table can be conformed at any time by the bubble 2*b* portion of the leveler to a reference point. Thus, the manufacture of a delicate professional table tennis table becomes possible, and since the leveler is manufactured by defining the bubble 2*b* after filling a liquid 2' into the transparent sealed tube 2*a*, a utilitarian advantage is obtained in that there is no worry of damage, it is low in cost and its indication is exact.

What is claimed is:

1. A horizontally-maintained table tennis table which comprises:

a table tennis table top having two sections, one section being provided with a lateral coupling hole and the other section being provided with a lateral bar, said lateral bar being inserted into said lateral coupling hole to connect said two sections together, locking means for locking said two sections together, level-measuring means provided in the peripheral edges of the table tennis table top, table tennis table legs for supporting said table top, and height-adjusting means provided in the table legs.

2. The horizontally-maintained table tennis table of claim 1, wherein the height adjusting means is rotatable with left- and right-handed screw portions for raising and lowering the table top.

* * * * *